United States Patent [19]

Massey

[11] 4,204,788

[45] May 27, 1980

[54] SQUARING DEVICE FOR STORAGE OF RODS, TUBES, AND LIKE ARTICLES

[76] Inventor: John P. Massey, 421 Ruby Ave., Clarendon Hills, Ill. 60514

[21] Appl. No.: 929,579

[22] Filed: Jul. 31, 1978

[51] Int. Cl.[2] ..... B65B 35/40

[52] U.S. Cl. ..... 414/21; 198/456; 271/221; 414/28; 414/745

[58] Field of Search ..... 414/21, 28, 35, 36, 414/608, 621, 745; 198/456; 271/210, 221, 222

[56] References Cited

U.S. PATENT DOCUMENTS

| | | | |
|---|---|---|---|
| 1,935,767 | 11/1933 | Delany | 271/222 |
| 2,137,478 | 11/1938 | Delany | 271/222 |
| 3,102,627 | 9/1963 | Acton et al. | 198/456 X |
| 3,497,084 | 2/1970 | Murrah | 414/21 |
| 4,045,071 | 8/1977 | Dunstan | 414/608 X |

FOREIGN PATENT DOCUMENTS

| | | | |
|---|---|---|---|
| 1116513 | 6/1968 | United Kingdom | 414/28 |

*Primary Examiner*—L. J. Paperner

*Attorney, Agent, or Firm*—Kinzer, Plyer, Dorn & McEachran

[57] ABSTRACT

A material handling device for aligning a stock of articles such as steel bars, pipe or tubing in open-ended trays or like containers for storage. The device supports a container filled with stock between a pair of squaring heads which are drawn together to contact the ends of the stock extending beyond the ends of the container. The stock is shifted in the container until the squaring heads squeeze the articles therebetween. The squaring heads are then returned to a rest position to await the next squaring cycle.

5 Claims, 9 Drawing Figures

SQUARING DEVICE FOR STORAGE OF RODS, TUBES, AND LIKE ARTICLES

BACKGROUND OF THE INVENTION

This invention relates to material handling systems and, in particular, warehousing systems for steel bars or tubing, aluminum bars or tubing, alloy steel bars, and other like elongated articles. The lengths of such items may range, for example, from twelve to twenty feet. Industry has for some time changed its primary concern in storage systems from area to volume considerations. This principle has resulted in frequent use of stacker systems for storage. A stacker system includes a framework forming a rack having a series of standard-sized pockets or cubicles. Containers or trays designed to fit into the pockets of the rack hold the stored articles. The stacker system is served by either an overhead crane or a mobile lift truck high mast unit to deposit and retrieve particular trays. While the rack and its trays may be variously sized for different applications, a typical tray size for storage of rod and tube stock is twenty-four inches wide by eight inches high by nine feet long. Between five thousand and ten thousand pounds of steel may be stored in such a container.

Each container contains bars or tubing separated according to type, size and length. The trays are located in the stacker system in an organized, systematic pattern. Allowances are made for clearances between the trays. When trays are made up, the preferred arrangement is to have both ends of the stock squared and also to have the stock central to the tray. When the trays are filled and squared they are located in the rack system with clearance. Stock that is not squared may not fit in an assigned pocket; a tray with stock that is staggered instead of squared (on either end or both) may interfere with movement of other trays into and out of adjacent positions in the rack.

SUMMARY OF THE INVENTION

An object of this invention is the squaring of articles in storage trays in an efficient, economical and expeditious manner.

Another object is the locating of articles central to their storage tray on a corresponding basis.

Another object is to weigh the articles placed in their storage trays during the squaring and centralizing procedures.

Another object is to accomplish the squaring and centralizing functions simultaneously.

Accordingly, the invention relates to a squaring device for use in a material handling and storage system for rods, tubing, and like stock articles of predetermined lengths, of the type comprising a rack including a plurality of storage pockets or cubicles, a plurality of open-ended containers for holding stock articles and designed to fit into the rack pockets with clearances between containers, the containers having lengths shorter than the lengths of the stock articles stored therein, and means for depositing and retrieving containers in the pockets. The squaring device is employed to locate stock articles in centered relation in the containers so that the articles will not interfere with movements of other containers in use of the storage system. The squaring device comprises an elongated base, a pair of squaring heads mounted on the base in facing relation to each other and movable along the base toward each other from initial rest positions, and container support means, on the base, for supporting one of the containers in approximately centered relation to a centerline midway between the rest positions of the squaring heads, with the open ends of the container facing the squaring heads. Motive means, connected to the squaring heads, are provided for driving the squaring heads toward each other simultaneously and at equal speeds to engage the ends of the stock articles and square the stock articles in centered relation in the container; the motive means further includes means for driving the squaring heads simultaneously back to their rest positions. The container support means comprises a pair of dollies, each mounted on wheels engaged in tracks extending longitudinally of the base, and the positions of the dollies are adjustable to accommodate containers and stock articles of varying lengths.

DESCRIPTION OF THE PREFERRED EMBODIMENT

Figures 1A, 1B:
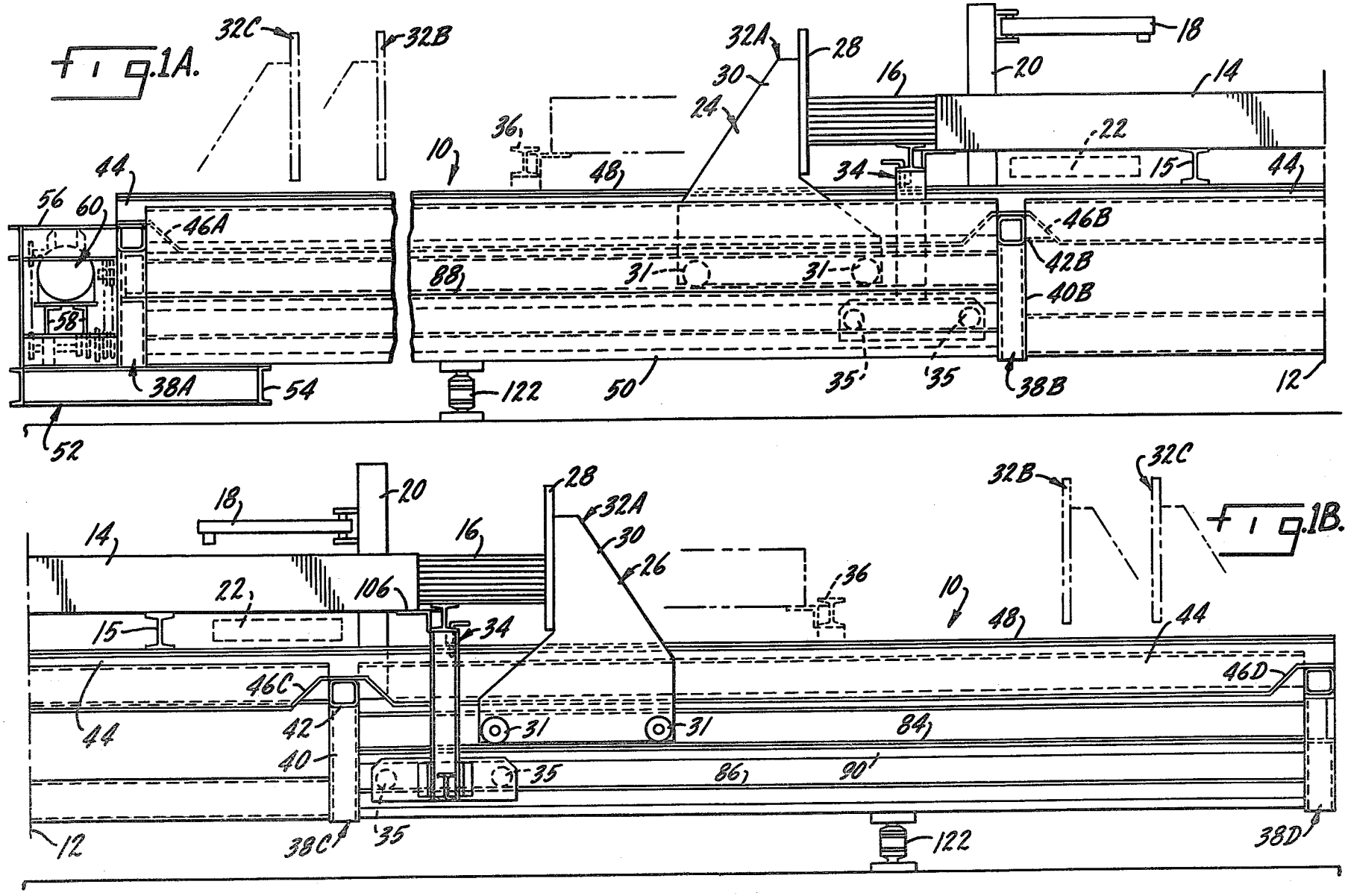
FIGS. 1A and 1B jointly constitute a side elevation view of a squaring device, constructed in accordance with the invention, the view being broken near the mid-line.

FIGS. 1A and 1B show a material handling device 10 according to the present invention. For convenience, this showing of a single device is separated into two halves along a center line 12.

An open-ended container or tray 14 rests on a pair of fixed transverse beams 15 on top of the squaring device 10 at its mid-section. Tray 14 typically has two sides and a bottom but no top or ends. Steel bars, tubing or other stock items 16 to be stored are placed in the container 14 with the ends of the stock 16 extending beyond the ends of the tray. Pivoted swing arms 18 mounted on pillars 20 can be used to check the height of stacked articles piled above the height of the container sides. Container lifting locations are shown by the dotted boxes 22. An overhead crane or a mobile lift truck can be used to place the tray 14 on the squaring device 10 and later remove it for emplacement in a pocket in a storage system.

A pair of squaring heads 24 and 26 perform the actual shifting of staggered stock in the container 14. Each squaring head has a face plate 28 rigidly attached to a carriage 30 supported on wheels 31. The squaring heads are in facing relation and are capable of moving back and forth along the length of the squaring device 10. A maximum squaring head advance position 32A (or 32B, in phantom, for longer stock) is determined by the length of the stock. At the conclusion of each squaring procedure, they return to rest positions shown in phantom at 32C.

Two mobile container supports or dollies 34 are incorporated in device 10. Like the carriages for the squaring heads 24 and 26, the dollies 34 also move, on wheels 35 supported by tracks, to accommodate varying container sizes. For example, the dollies 34 may be moved away from the center line 12 to the positions shown in phantom at 36 to support a longer container. The dollies are moved manually to the desired positions appropriate to the trays being processed.

The basic structure of the squaring device 10 is that of a long channel or box. Included in the structure are four main transverse frames 38A–38D. Each transverse frame has two legs 40 connected by a transverse box beam 42. Interconnecting the transverse frames 38A–D are two I-beams 44. These beams 44, located at the middle of the box beams 42, extend almost the entire length of the machine. The I-beams 44 have notched portions 46A through 46D accommodating the box beams 42. A cover pad 48 is positioned on top of the I-beams 44.

Fastened on the outside of each transverse frame leg 40 is a side panel 50. In the portions of the device between transverse frames 38A–38B and 38C–38D, the side panels have tracks attached thereto which support the carriages 30 for the squaring heads 24 and 26, and the dollies 34. The side panels between frame sections 38B–38C, at the mid-section of the machine 10, do not have these tracks.

At the left-hand end of FIG. 1A is a drive means to drive squaring heads 24 and 26 toward and away from each other. Included in this drive means is a frame 52 including a base girder 54, a cantilever beam 56, and two motor mounts 58.

Figure 2:
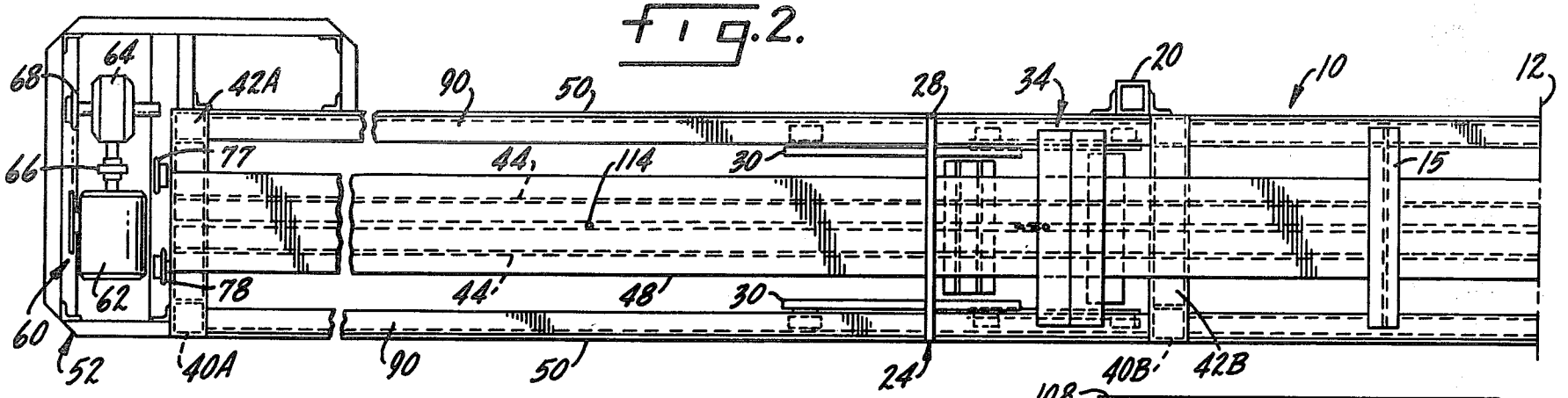
FIG. 2 is a plan view of the left half of the squaring device of FIGS. 1A and 1B.
Figure 3:
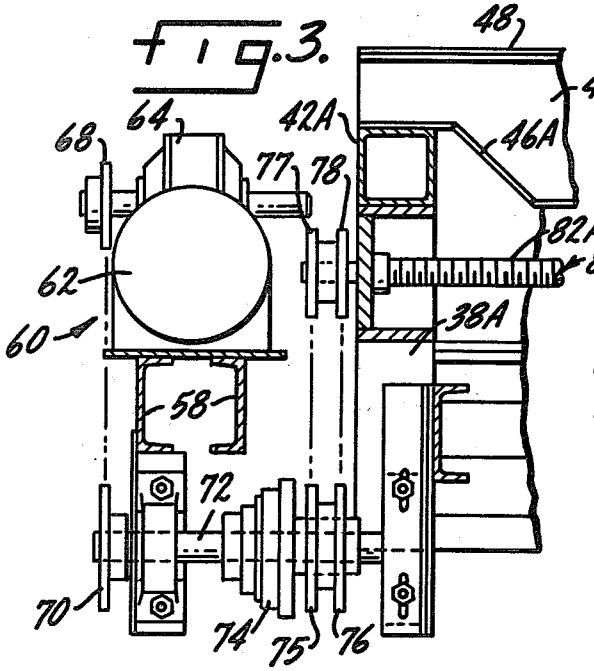
FIG. 3 is a side elevation view of the left end of the squaring device, showing the drive mechanism.
Figure 4:
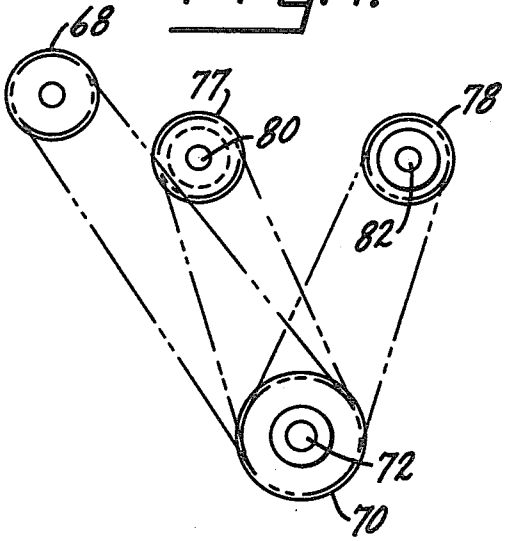
FIG. 4 is a schematic end elevation view of the drive shafts and sprockets for the squaring device.

The drive or motive means 60 is mounted on frame 52 and includes a motor 62 connected to a gear box 64 through a suitable coupling 66 (FIG. 2). The output shaft of the gear box has a pulley 68 which is connected to an idler pulley 70 on an idler shaft 72 (FIGS. 3 and 4). A clutch 74 connects shaft 72 to two sprockets 75 and 76 (FIG. 3). Suitable chains connect the sprockets 75 and 76 to two drive sprockets 77 and 78, respectively (FIG. 4). The drive sprockets 77 and 78 are mounted on two ball-screw drive shafts 80 and 82, respectively. These shafts extend the length of the device 10 and are used to drive the squaring heads 24 and 26.

Drive shaft 82 comprises three shaft sections 82A, 82B and 82C coupled together. In the portion of the machine between transverse frames 38A–38B (see FIG. 3) threads of the first drive shaft section 82A advance in one direction. In the vicinity of box beam 42B, there is a coupling connecting the shaft section 82A to an unthreaded center section 82B which extends through the mid-section of the machine. At box beam 42C another coupling 83 (FIG. 5) connects the unthreaded shaft section 82B to another threaded section 82C which extends through the right-hand side of the device. The threads on shaft section 82C advance in the opposite direction to those of the section 82A. The other drive shaft 80 is of corresponding sectionalized construction, with oppositely directed threads on the end sections of the shaft. Consequently, the squaring heads 24 and 26, which are connected to the threaded portions of the shafts, move in opposite directions, either toward one another or away from each other, depending on which way the shafts are rotating. Uniform thread sizes assure that the squaring heads advance and retract at the same rate. Thus, if the squaring heads are initially located such that the center line 12 is midway between them, that line always represents the mid-point of the separation between the squaring heads, regardless of how far apart they are.

Figures 5, 6, 8:
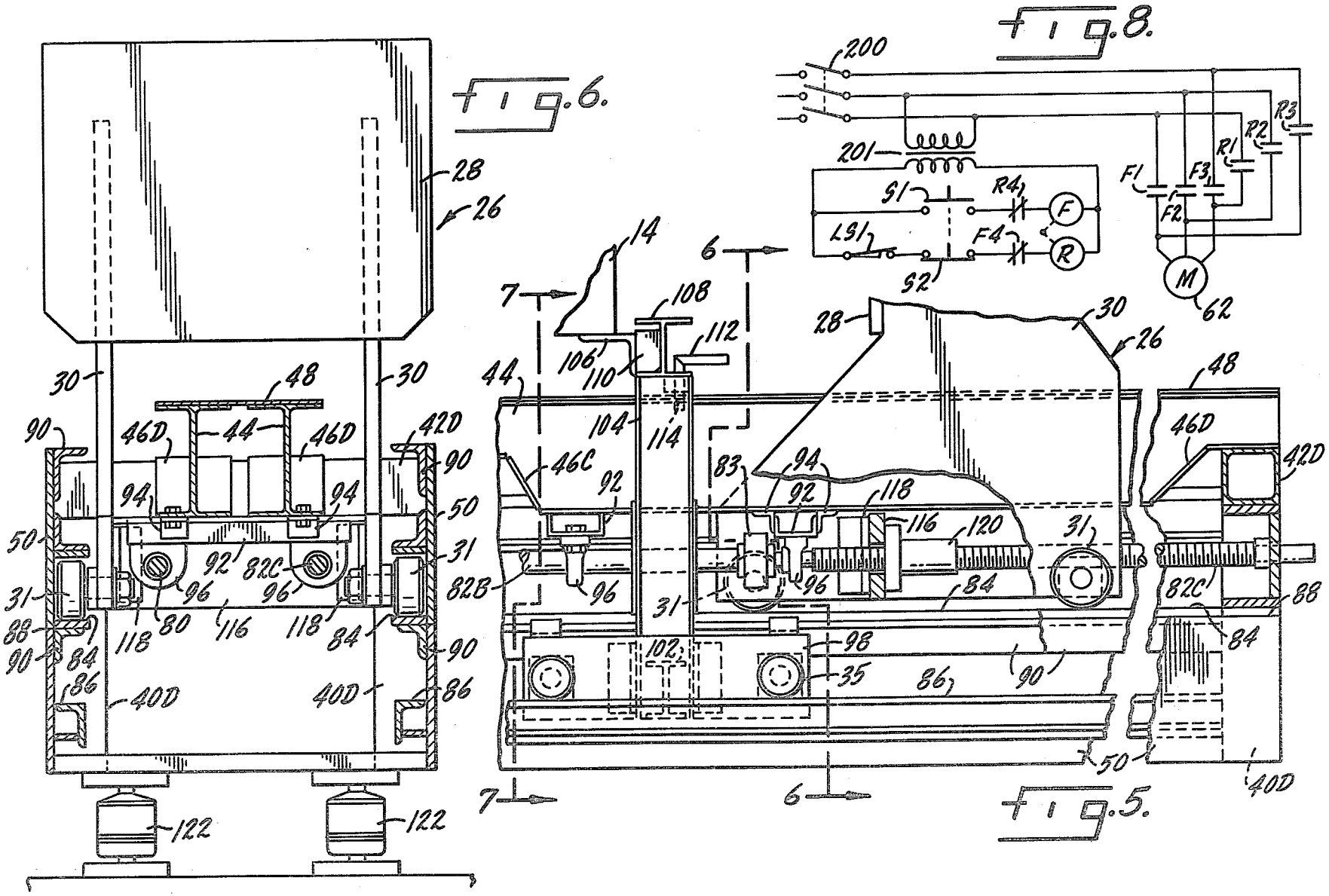
FIG. 5 is an enlarged side elevation view of the squaring head and support dolly, partially cut away, showing the screw drive and its connections.
FIG. 6 is a section view taken approximately along line 6—6 of FIG. 5, showing the squaring head.
FIG. 8 is a schematic diagram of a simplified control for the device.

The drive shafts 80 and 82 are supported below the I-beams 44. As seen in FIGS. 5 and 6, the shaft supports include hangers 92 attached either directly to the I-beams 44 or to brackets 94 which are in turn fastened to the I-beams. The shafts 80, 82 run through bearing blocks 96.

Figure 7:
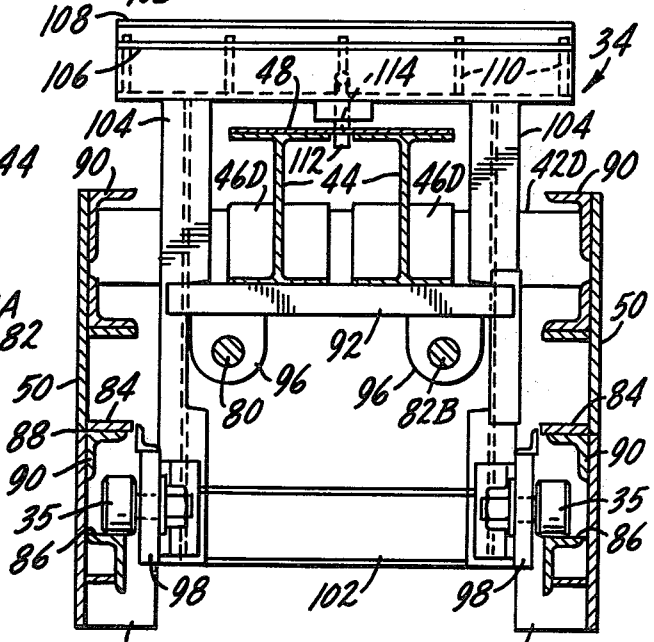
FIG. 7 is a section view taken approximately along line 7—7 of FIG. 5, showing the support dolly.

The details of the squaring heads and their carriages, the support dollies, and their associated tracks can best be seen in FIGS. 6 and 7. The tracks are mounted on the inside of side panels 50. Each side panel has an upper track 84 which supports the wheels 31 of the squaring head carriages 30 (FIG. 6). A lower track 86 supports wheels 35 of the dollies 34 (FIG. 7). The side panels 50 can be split as at 88 for ease of construction. Angle members 90 may be added as required to stiffen the side panels.

Each dolly 34 (FIG. 7) includes two lower side frames 98 on which the wheels 35 are mounted. The side frames are interconnected by a transverse member 102. Two upright members 104 extend from the side frames to a point above the I-beams 44. Extending between the upright members is a tray support angle 106 and an article support beam 108. Stiffeners 110 may be added also. Each dolly further includes a pin 112 which fits in one of a plurality of holes 114 located in the cover pad 48 of the I-beams (see FIG. 2). This fixes the dolly's position.

The carriages 30 for the squaring heads (FIG. 6) each include a drive plate 116 connected between the two sides of the carriage by angles 118. As seen in FIG. 5, a drive collar 120 is bolted to the drive plate 116. The drive collar has internal threads complementary to those of the ball screw shaft 82. Ball bearings are trapped in the grooves of the complementary threads, connecting the shaft to the collar. Thus, when the drive shaft rotates the squaring head moves in one direction or the other along the upper track 84.

Load cells 122 may be used to support the entire squaring device 10, as shown in FIGS. 1A, 1B and 6. These can be set to give a readout of the weight of the stock in the container 14. In an alternate embodiment, the load cells 122 may be deleted with appropriate legs taking their place to support the machine.

FIG. 8 shows a simple, typical electrical control circuit for squaring device 10, comprising a three phase disconnect switch 200 connected to a suitable A.C. power supply (not shown). The drive motor 62 of device 10 is connected to the three phase line by a first series of normally open contacts F1–F3 providing rotation in one direction and by a second series of normally open contacts R1–R3 for rotation in the opposite direction. A transformer 201 is provided to energize two mechanically interlocked motor contactor coils F and R. The circuit for coil F includes, in series, a normally open momentary contact switch S1 and a set of normally closed contacts R4. The circuit for coil R includes, in series, a normally closed limit switch LS1, a normally closed momentary contact switch S2 gauged with switch S1, and a set of normally closed contacts F4.

In operation of the squaring device 10, a container or tray 14 is placed on the device, supported by the fixed transverse beams 15 and the tray support angles 106 of the dollies 34. Using an overhead crane or a lift truck, the steel rods, tubing, or other stock articles 16 are placed in the tray. The operator then actuates switch S1 to energize the drive motor 62, which drives the two shafts 80 and 82 in a forward direction to move the squaring heads 24 and 26 toward each other. The squaring heads advance toward each other, with the face plates 28 contacting any staggered ends of the stock. Such pieces are pushed back toward the center of the tray. The squaring heads 24, 26 advance until the stock has been squared and has also been centered in the tray 14. The operator then releases the switch S1; switch S1 opens and switch S2 closes. This reverses the direction of rotation of the shafts 80, 82, by reversing motor 62, thus returning the squaring heads toward their rest positions, as when one of the heads reaches its rest position, it opens the limit switch LS2, de-energizing the motor 62; the device is ready for its next cycle of operation. Of course, a reversing drive coupling can be employed instead of a reversible motor. The details of the electrical control can be varied to suit design preferences.

Since the squaring heads 24 and 26 are always equidistant from midline 12, it can be seen that if each tray 14 is centered over this midline then the stock 16 ends up being consistently centered in each tray.

While the drive means 60 has been shown and described as a screw drive, it will be understood that other systems for imparting linear motion could be employed. For example, a cable or chain drive could be used for the squaring heads. Simple runners could be substituted for the wheels and tracks of the squaring heads and dollies. Likewise, other details could be changed without departing from the invention's fundamental theme.

I claim:

1. In a material handling and storage system for rods, tubing, and like stock articles of predetermined lengths, of the type comprising a rack including a plurality of storage pockets or cubicles, a plurality of open-ended containers for holding stock articles and designed to fit into the rack pockets with clearances between containers, the containers having lengths shorter than the lengths of the stock articles stored therein, and means for depositing and retrieving containers in the pockets, the improvement comprising a squaring device for locating stock articles in centered relation in the containers so that the articles will not interfere with movements of other containers in use of the storage system, the squaring device comprising:

an elongated base;

a pair of squaring heads mounted on the base in facing relation to each other and movable along the base toward each other from initial rest positions;

container support means, comprising a pair of dollies, each mounted on wheels engaged in tracks extending longitudinally of the base, for supporting one of the containers in approximately centered relation to a centerline midway between the rest positions of the squaring heads, with the open ends of the container facing the squaring heads, the dollies being adjustable, longitudinally of the base, to accommodate containers and stock articles of varying lengths;

and motive means, connected to the squaring heads, for driving the squaring heads toward each other simultaneously and at equal speeds to engage the ends of the stock articles and square the stock articles in centered relation in the container;

the motive means further including means for driving the squaring heads simultaneously back to their rest positions.

2. A squaring device for a storage system, as set forth in claim 1, in which each squaring head comprises a carriage mounted on wheels engaged in tracks extending longitudinally of the base, and in which the motive means comprises at least one screw thread shaft extending longitudinally of the base and operationally connected to both squaring head carriages, the shaft threads being oppositely directed for the two carriages.

3. A squaring device for a storage system, as set forth in claim 2, in which the motive means comprises two parallel screw thread shafts driven from a single motor and each operationally connected to both squaring head carriages.

4. A squaring device for a storage system, as set forth in claim 1, in which each squaring head comprises a carriage mounted on wheels engaged in tracks extending longitudianlly of the base, and in which the motive means comprises at least one screw thread shaft extending longitudinally of the base and operationally connected to both squaring head carriages, the shaft threads being oppositely directed for the two carriages.

5. A squaring device for a storage system, as set forth in claim 1, in which the base is supported upon load cells for measuring the weight of the stock in each container.

* * * * *